US006484531B1

(12) United States Patent
Hambleton et al.

(10) Patent No.: US 6,484,531 B1
(45) Date of Patent: Nov. 26, 2002

(54) INSULATED CABINET FOR INSTALLATION IN A HOME EXTERIOR WALL

(76) Inventors: John D. Hambleton, 202 S. 2nd St., Guthrie Center, IA (US) 50115; David M. Hunt, Sr., 2413 - 170th, Guthrie Center, IA (US) 50115

( * ) Notice: Subject to any disclaimer, the term of this patent is extended or adjusted under 35 U.S.C. 154(b) by 0 days.

(21) Appl. No.: 09/908,031

(22) Filed: Jul. 18, 2001

(51) Int. Cl.[7] ..... F25D 23/00
(52) U.S. Cl. ..... 62/440; 312/286
(58) Field of Search ..... 62/440, 441; 312/286, 312/287; 109/67, 68

(56) References Cited

U.S. PATENT DOCUMENTS 2,579,379 A 12/1951 Fritsche
4,024,729 A 5/1977 Abate
4,626,049 A 12/1986 Gross
5,921,191 A 7/1999 Gabel
6,079,216 A 6/2000 de Marsillac Plunkett
6,220,049 B1 4/2001 Lajeunesse

*Primary Examiner*—William E. Tapolcai
(74) *Attorney, Agent, or Firm*—Henderson & Sturm LLP

(57) ABSTRACT

The present invention provides a convenient means for delivery personnel to deliver refrigerated goods to a building without having to wait until the building owner is home. The invention provides a dual-access insulated cabinet installable into the exterior wall of a home, with outside and inside doors. Both outside and inside doors contain lockable mechanisms for securing the doors. The insulated cabinet includes a main compartment for storing items to be frozen, an interior compartment for inserting into the wall of a building, and a cooling apparatus connected to the main compartment for selectively cooling the insulated cabinet to a selected temperature. An optional indicator light is inside whereby the light turns on when a delivery of refrigerated goods is made through the outside door of the invention. The indicator light then resets to the off state when the resident of the building opens the inside door of the present invention.

12 Claims, 3 Drawing Sheets

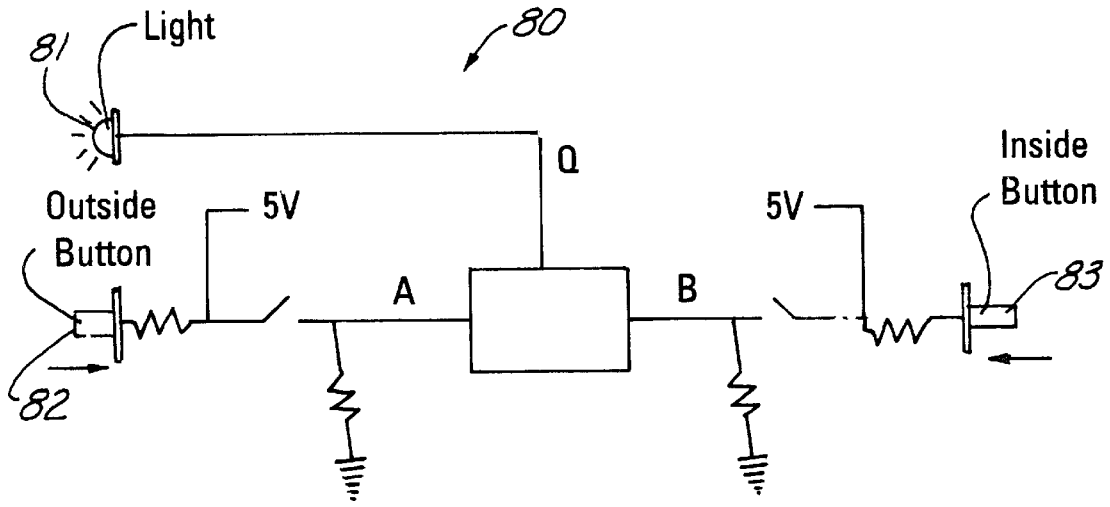
Fig. 8
Truth Table
84
| A | B | Qn+1 |
|---|---|---|
| 0 | 0 | 1 |
| 0 | 1 | 1 |
| 1 | 0 | 0 |
| 1 | 1 | Qn |
Fig. 9
Logic Diagram
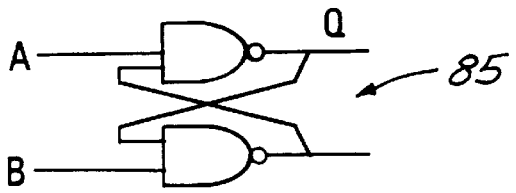
Fig. 10

INSULATED CABINET FOR INSTALLATION IN A HOME EXTERIOR WALL

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

1. Field of the Invention

This present invention relates to the field of freezers or refrigerators, and more particularly to freezers or refrigerators installed in the wall of a building for opening on both sides of a wall.

2. Description of the Related Art

Refrigerators are well known in the art. Typical refrigerators are used either completely inside or outside buildings. Refrigerators are also commonly installed onto vehicles for the transportation of food. Typical refrigerators are not designed to fit within the wall of a building with doors to open the refrigerator on both sides of the wall.

As can be seen by reference to the following U.S. Pat. No. 4,024,729 "Refrigerated Milk Container", and U.S. Pat. No. 6,079,216, "Refrigerator For Securely Accepting Deliveries", the prior art is replete with myriad and diverse refrigerators for installing in the wall of a building.

U.S. Pat. No. 6,079,216, titled "Refrigerator For Securely Accepting Deliveries" enables the user to open the refrigerator from both sides, and is insertable into the wall of a building, and contains an optional additional freezer compartment. However, the aforesaid invention does not provide for a grooved secure fit on the exterior of the building wall. In addition, U.S. Pat. No. 4,024,729 provides for a refrigerator mounted in the exterior wall of a building. However, the aforesaid patent does not provide for a freezer, and does not provide a grooved secure fit on the exterior of the building.

Companies delivering perishable refrigerated goods often must wait until the residents of a home are present before making a delivery. This practice might require more than one attempt at a delivery of goods to a residence, or else require idling of delivery personnel until the resident answers a telephone call made to determine whether the resident is at home. This inefficient use of company resources can be alleviated with a device that permits delivery of the goods at any time, while maintaining perishable goods in a refrigerated or frozen state.

While all of the aforementioned prior art constructions are more than adequate for the basic purpose and function for which they have been specifically designed, they are uniformly deficient with respect to their failure to provide a simple, efficient, and practical dual-access freezer with secure grooved installation into a building wall and containing optional indicator lights.

As a consequence of the foregoing situation, there has existed a longstanding need for a new and improved insulated cabinet for installation in a home exterior wall, and the provision of such a construction is a stated objective of the present invention.

BRIEF SUMMARY OF THE INVENTION

Briefly stated, the present invention provides an insulated cabinet installable into the exterior wall of a home, with doors on the interior and exterior doors of the freezer. The outside and inside door panels are attached to the cabinet by hinges, and contain lockable mechanisms to secure the doors. The insulated cabinet includes a main compartment capable of storing items for refrigeration, an interior compartment for inserting into the wall of a building, and a lower compartment. The lower compartment contains a cooling mechanism connected to the main compartment for selectively cooling the insulated cabinet to a selected temperature.

The outside door of the insulated cabinet is accessible from the exterior of a building, and the inside door of the insulated cabinet is accessible from the interior of the building. The cabinet is secured by such means as bolts. The insulated cabinet contains an indicator light that turns on when a delivery of refrigerated goods is made to the insulated cabinet, the indicator light being turned off when the resident of the building opens the inside door of the insulated cabinet to retrieve the delivered refrigerated goods.

An object of the present invention is to provide a structure whereby commercial ice cream trucks and food delivery companies are able to deliver food to homes without having to wait until the homeowners are home to make the delivery.

BRIEF DESCRIPTION OF THE SEVERAL VIEWS OF THE DRAWING

These and other attributes of the invention will become more clear upon a thorough study of the following description of the best mode for carrying out the invention, particularly when reviewed in conjunction with the drawings, wherein:

FIG. 8 contains a schematic view of the circuitry for an indicator light.

FIG. 9 contains a schematic view of a truth table for the circuitry of the indicator light.

FIG. 10 contains a schematic view of a logic diagram for the circuitry of the indicator light.

DETAILED DESCRIPTION OF THE BEST MODE

Figure 1:
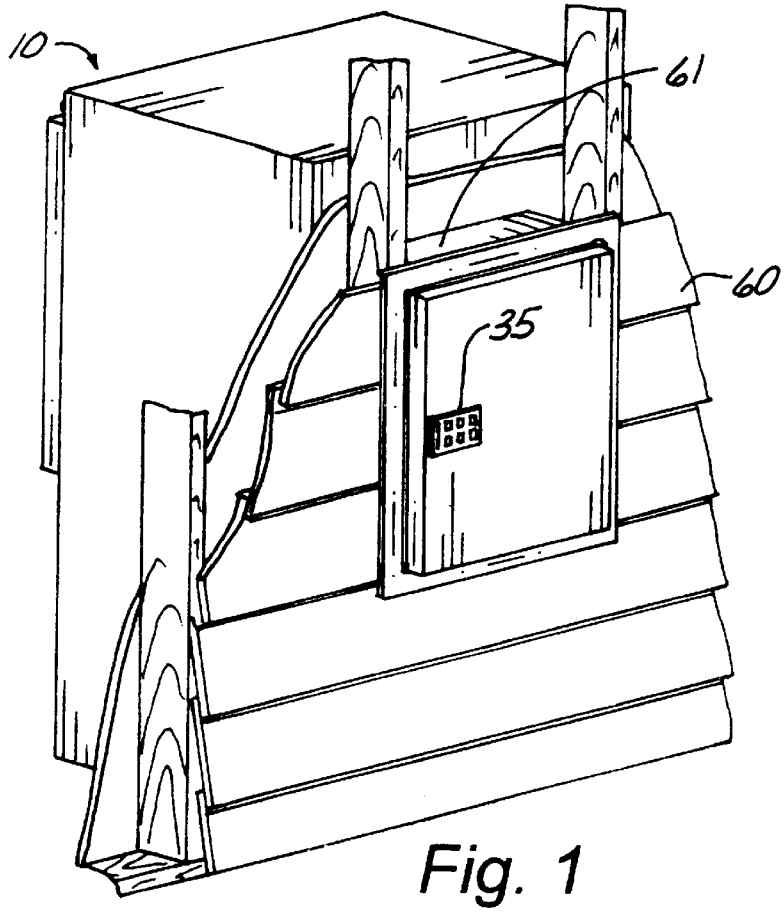
FIG. 1 contains a perspective view of the present invention installed into the wall of a building.

As can be seen by reference to the drawings, and particularly to FIG. 1, the insulated cabinet for installation in a home exterior wall that forms the basis of the present invention is designated generally by the reference number 10. The device 10 includes a main compartment 20 having a front aperture 21 and a rear aperture 22. The rear aperture 22 contains a hingedly rotatable door panel 23 which selectively covers the rear aperture 22. The front aperture 21 connects to an interior compartment 30.

Figure 2:
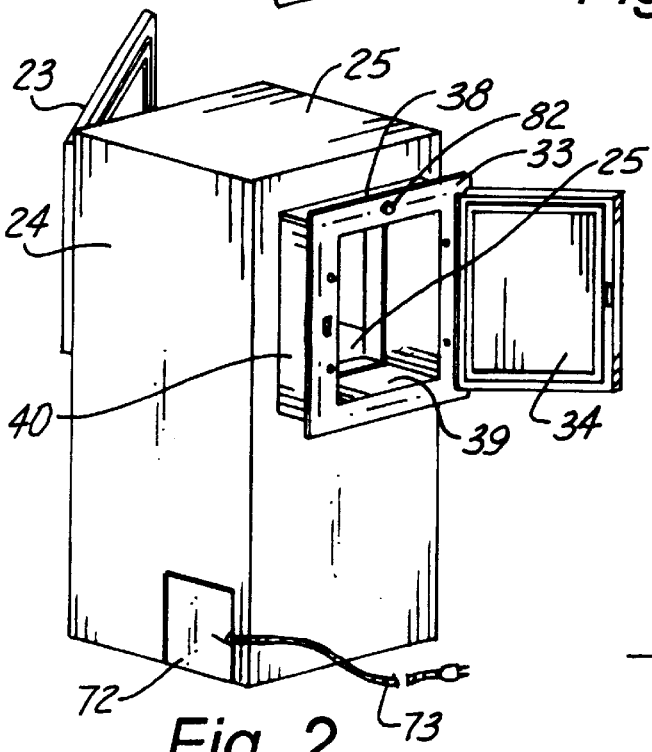
FIG. 2 contains a front perspective view of the present invention with both outside and inside door panels in the open position.
Figure 3:
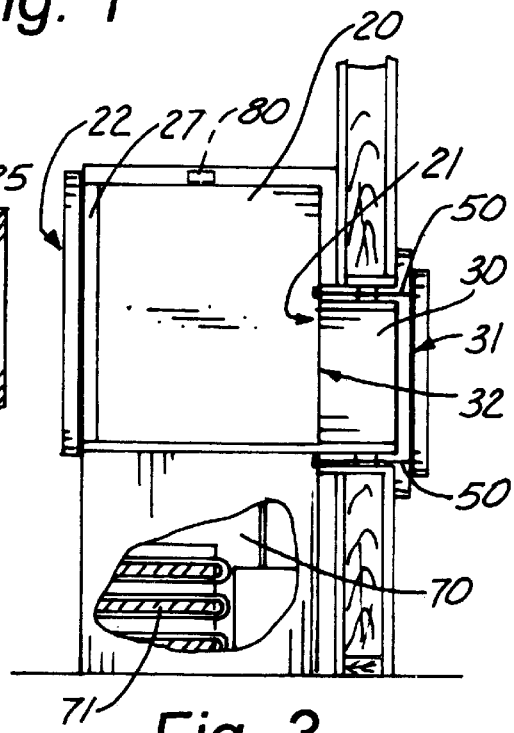
FIG. 3 contains a side elevational view with a portion broken away to show a cooling unit.

As shown in FIG. 2 and FIG. 3, the interior compartment 30 is spaced between the main compartment 20 and the outside door panel 34. The interior compartment 30 contains a top wall 38, a bottom wall 39, side walls 40, a front aperture 31 and a rear aperture 32. The front aperture 31 is connected to a flange 33. A hingedly movable door panel 34 is connected to the flange 33 which selectively covers the front aperture 31. The interior compartment 30 is approximately the width of the exterior wall of a building 60. In addition, a cooling apparatus 71 is connected to the main compartment 20 to selectively cool the main compartment 20 to a desired temperature. Frozen foods must be kept below 32° F. and preferably at about 0° F.

The main compartment 20 of the insulated cabinet 10 for installation in a home exterior wall includes two side walls 24 spaced apart by top and bottom walls 25. The walls of the invention 10 are preferably made of an insulated material. The outside door panel 34 and inside door panel 23 are preferably made of the same insulated material. Locking mechanisms 35 and 26 are located on the doors whereby the door panels 34,23 are selectively secured. A light indicator 81 on the inside door panel 23 is connected to turn on when the outside door panel 34 is opened. Reset circuitry 80 connected to the main compartment 20 is connected to turn off the light indicator 81 when the inside door panel 23 is opened. Reset buttons 82, 83 are located on the inside of the door panels to trigger the light indicator.

Figure 4:
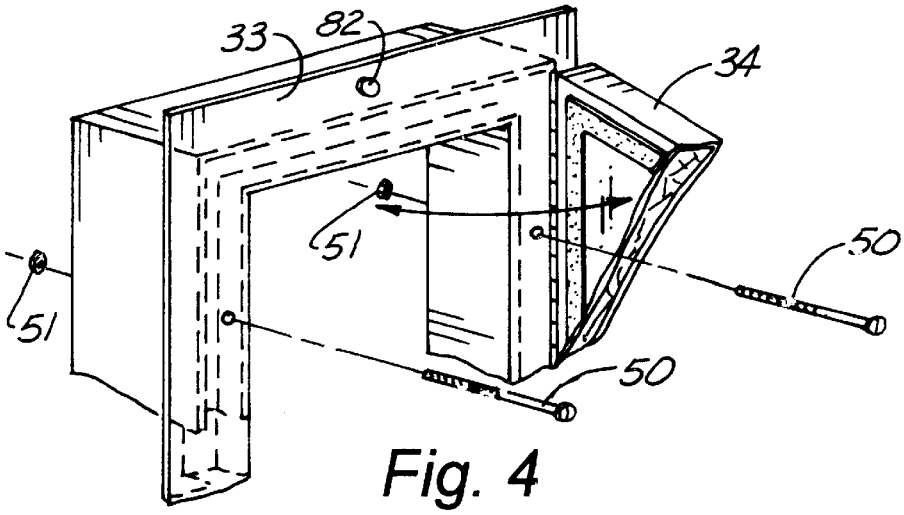
FIG. 4 contains an enlarged partial perspective view of a flange connected to a front aperture of the interior compartment.
Figure 5:
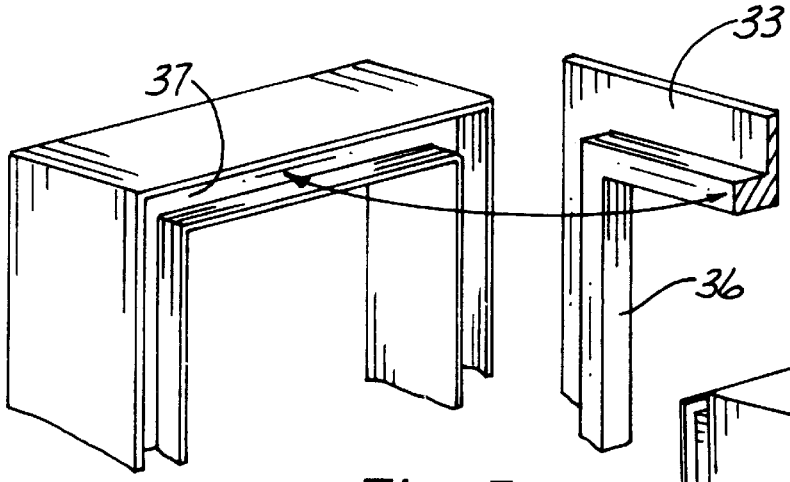
FIG. 5 contains an enlarged partial perspective view of a front aperture of an interior compartment with the flange removed.
Figure 7:
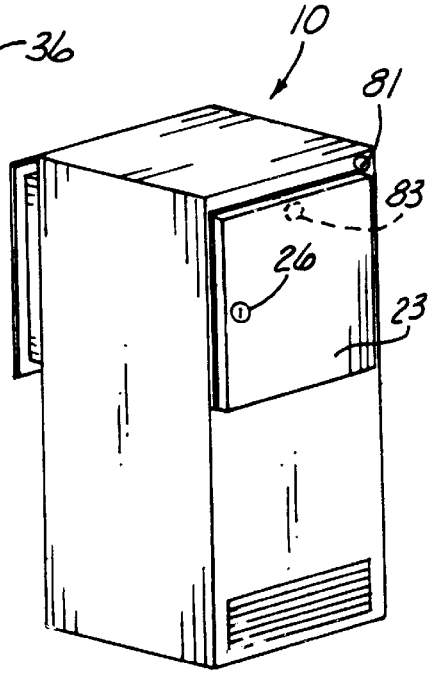
FIG. 7 contains a rear perspective view of the present invention.
Figure 6:
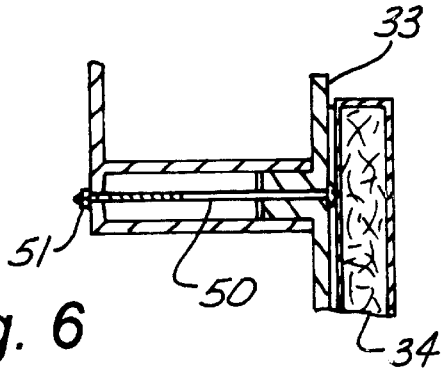
FIG. 6 contains an enlarged partial cross-sectional view of the flange bolted to the interior compartment, similar to that shown in FIG. 3.

A rim 27 follows the edge of the rear aperture 22 of the main compartment 20. As seen in FIG. 2, a flange 33 extends around the front aperture 31 of the interior compartment 30. As shown in FIG. 4 and FIG. 6, the flange 33 is rigidly connected to the interior compartment 30 by such means as bolts 50, the bolts 50 being receivably secured by nuts 51. As shown in FIG. 5, the flange 33 contains a protruding rim 36 on the interior of the flange 33 that fits into a groove 37 on the interior compartment 30. The walls of the invention 10 extend past the main compartment 20 and contain a lower compartment 70. The lower compartment 70 contains the cooling apparatus 71 for selectively adjusting the temperature in the main compartment 20. The lower compartment 70 contains an access panel 72 for performing maintenance on the cooling apparatus 71. An electric plug wire 73 is connected to the cooling apparatus 71 and protrudes out of the lower compartment 70 for connection to an electric outlet in the building 60.

In use, the interior compartment 30, affixed between the main compartment 20 and the outside door panel 34, is placed into an opening 61 in the wall of a building 60. Thereafter, the main compartment 20 is accessible from both inside the building 60, and outside the building 60. After the interior compartment 30 is placed into the opening 61 in the building 60, the protruding rim 36 of the flange 33 is placed into the slot 37 in the interior compartment 30. Thereafter, the interior compartment 30 is secured to the flange 33 by such items as bolts 50, and receivably secured with nuts 51. The insulated cabinet's 10 electric plug wire 73 is then connected to an electric outlet in the building 60 for driving the cooling apparatus 71 in the lower compartment 70 of the insulated cabinet 10.

When maintenance is required on the cooling apparatus 71 in the lower compartment 70 of the insulated cabinet 10, the access panel 72 is removed. After completion of the maintenance on the cooling apparatus 71 in the lower compartment 70 of the insulated cabinet 10, the access panel 72 is replaced.

In one embodiment of the invention, a delivery person unlocks the outside door panel 34 of the present invention 10. Then, the delivery person opens the outside door panel 34 and places delivered food into the main compartment 20. Opening of the outside door panel 34 turns on an indicator light 81 near the top of the inside door panel 23, and the indicator light 81 remains on after the delivery person has left. A resident of the building 60 may subsequently unlock and open the inside door panel 23 of the invention 10 and remove the delivered items. When the inside door panel 23 is opened, the indicator light 81 is then turned off by circuitry 80 attached to the main compartment 20. FIG. 8 shows the circuitry for the indicator light 81. FIG. 9 shows the truth table 84 for the circuitry 80, which is a common flip-flop latch circuit 85 (FIG. 10). This permits the delivery person to make deliveries to homes when the occupant is not home, thereby freeing up time to sell to new customers or the delivery person can deliver when occupants are at work, for example, and sell to new customers during evening hours when people are more likely to be home.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. An insulated cabinet comprising:

a main compartment having a top wall, a bottom wall, two side walls, a front aperture and a rear aperture;

an interior compartment connected to the front aperture of said main compartment, said interior compartment having a top wall, a bottom wall, two side walls, a front aperture and a rear aperture;

a rim having a groove disposed therein around said front aperture of the interior compartment;

an apparatus for selectively cooling the temperature in said main compartment;

a rim disposed around the edge of the rear aperture of said main compartment;

a flange disposed around the front aperture of said interior compartment, said flange having a protruding rim that fits into said groove;

an outside door panel hingedly attached to said flange;

a locking mechanism operably disposed on the outside door panel to selectively secure said outside door panel to the flange for selectively locking the outside door panel to the flange;

an inside door panel hingedly attached to the rim of the rear aperture of said main compartment; and a locking mechanism operably disposed on the inside door panel for selectively locking the inside door.

2. The insulated cabinet of claim 1, wherein a light indicator is attached to said inside door panel for indicating when said outside door panel is opened.

3. The insulated cabinet of claim 2, wherein a reset apparatus attached to said main compartment resets said light indicator to the off state when said inside door panel is opened.

4. The insulated cabinet of claim 1, wherein said cabinet contains an access panel for maintaining said cooling apparatus, and an electric power plug for connecting said cooling apparatus to electric power.

5. The apparatus of claim 1 wherein said interior connecting compartment is narrow enough such that it is capable of being placed into an opening between studs in the wall of a building.

6. The insulated cabinet of claim 1, wherein said interior connecting compartment thickness being greater than or equal to the thickness of a building wall.

7. The apparatus of claim 1 wherein the interior connecting compartment is installed in the wall of a building such that the outside door panel of the present invention is disposed outside of the building so it is only capable of being opened from outside said building, and the inside door panel of this invention is disposed inside of the building so that it is only capable of being opened from inside said building.

8. The apparatus of claim 1 wherein the walls of said invention comprise an insulated material capable of retaining selectable refrigeration temperatures inside said main compartment of said invention.

9. The apparatus of claim 1 wherein said flange is secured to the interior compartment from the exterior of a building.

10. The apparatus of claim 4 including means for cooling said main compartment.

11. The apparatus of claim 6 including means for cooling to a temperature at least as low as 32 degrees Fahrenheit.

12. The apparatus of claim 6 including means for cooling to a temperature at least as low as 0 degrees Fahrenheit.

* * * * *